US006254056B1

(12) United States Patent
Alfred

(10) Patent No.: US 6,254,056 B1
(45) Date of Patent: Jul. 3, 2001

(54) CLAMP/WALER BRACKET USED WITH CONCRETE FORMS

(76) Inventor: Greg Alfred, 4398 Elati St., Denver, CO (US) 80216

( * ) Notice: Subject to any disclaimer, the term of this patent is extended or adjusted under 35 U.S.C. 154(b) by 0 days.

(21) Appl. No.: 09/398,601

(22) Filed: Sep. 17, 1999

Related U.S. Application Data

(60) Provisional application No. 60/100,794, filed on Sep. 18, 1998.

(51) Int. Cl.[7] ..... E04G 17/00
(52) U.S. Cl. ..... 249/219.1; 249/219.2
(58) Field of Search ..... 249/40, 46, 38, 249/190, 219.2

(56) References Cited

U.S. PATENT DOCUMENTS

| | | | | |
|---|---|---|---|---|
| 2,967,689 | * | 1/1961 | Jahn | 249/219.2 |
| 3,174,203 | * | 3/1965 | Kemper | 249/219.2 |
| 3,216,690 | * | 11/1965 | Jahn | 249/219.2 |
| 3,235,217 | * | 2/1966 | Jahn | 249/219.2 |
| 3,462,106 | * | 8/1969 | Buyken | 249/219.2 |

* cited by examiner

*Primary Examiner*—Michael Safavi
(74) *Attorney, Agent, or Firm*—Edwin H. Crabtree; Ramon L. Pizarro; Donald W. Margolis

(57) ABSTRACT

A clamp/waler bracket used in concrete form construction. The bracket is used to releasably engage a tie-rod extending outwardly from an outside of a plywood panel. The bracket is used to compress a wood brace against the side of the panel to prevent the panel from bowing. The bracket includes a vertical tie-rod connecting arm having an upper portion, a center portion and a lower portion. The connecting arm includes a hole therein adapted for receiving a tie-head and a portion of the tie-rod therethrough. An eccentric handle with a cam and cam channel is pivotly attached to the upper portion of the connecting arm. A first end of an angle arm is integrally formed in the lower portion of the connecting arm. The angle arm extends downwardly and at an angle from the connecting arm. A second end of the angle arm is integrally formed in a lower portion of a vertical panel arm. The panel arm is adapted for receipt next to the outside of the panel. An upper portion of the panel arm is bent outwardly at 90 degrees forming a brace ledge. A pair of brace tabs are formed in the center portion of the connecting arm and bent inwardly at 90 degrees. The ledge and the tabs are used for receiving the wood brace thereon. When the handle engages the tie-rod, the upper portion of the connecting arm compresses the wood brace against the panel.

17 Claims, 1 Drawing Sheet

CLAMP/WALER BRACKET USED WITH CONCRETE FORMS

This application is based on a provisional application filed in the U.S. Patent and Trademark Office on Sep. 18, 1998, Ser. No. 60/100,794, title "CLAMP/WALER BRACKET USED WITH CONCRETE FORMS by the subject inventor.

BACKGROUND OF THE INVENTION

1. Field of the Invention

This invention relates to concrete form brackets and more particularly, but not by way of limitation, to a bracket used for compressing a wood brace against the side of a concrete form plywood panel used in forming concrete walls and foundations.

2. Discussion of Prior Art

In U.S. Pat. Nos. 2,967,689, 3,235,217 and Des. 192,231 to Carl M. Jahn of Denver, Colo., a clamp bracket for concrete forms and a wedging detent for waler brackets are disclosed. These type of brackets are used for engaging tie-rods used in concrete form construction and securing 2×4 inch wood braces against the side of typically 4×8 foot plywood panels. The plywood panels used in forming concrete walls, foundations and like structures.

The subject inventor is a principal in Alfred Manufacturing Company, Denver, Colo. This company has been a manufacture of the above mentioned clamp brackets for years. These brackets are marketed nationwide for use in the building construction industry. The brackets are sold under a brand name of the "JAHN BRACKET". The brackets are also referred to in the industry as the "A" bracket.

The new clamp/waler bracket is similar in structure and function when compared to the above mentioned Jahn clamp bracket but with substantial improvements and modifications which are described herein.

SUMMARY OF THE INVENTION

In view of the foregoing, it is a primary object of the subject invention to provide an improved clamp/waler bracket which is rugged in construction, simple in design and prevents bending and damage to the bracket when the bracket compresses a wood brace against the side of a plywood concrete form panel during a concrete pour. Bending and damage to prior art brackets occurred particularly when undersized 2×4 inch wood braces were used during the building of the concrete forms. The subject improved clamp/waler bracket eliminates this problem.

Another object of the clamp/waler bracket is by improving the simplicity of bracket design, the amount of material previously used in the construction of brackets of this types is reduced thereby reducing the cost of manufacture.

The clamp/waler bracket includes a vertical tie-rod connecting arm having an upper portion, a center portion and a lower portion. The connecting arm includes a hole therein for receiving the tiehead and a portion of the tie-rod therethrough. An eccentric handle with a cam and cam channel is pivotly attached to an upper portion of the connecting arm. The cam and cam channel are used for releasably engaging the tie-rod. A first end of an angle arm is integrally formed in the bottom portion of the connecting arm. The angle arm includes a reinforcing rib and gussets for added strength. The angle arm extends downwardly and at an angle in a range of 30 to 75 degrees from the vertical tie-rod connecting arm. A second end of the angle arm is integrally formed in a bottom portion of a vertical panel arm. The vertical panel arm is adapted for receipt next to the outside of the plywood panel. An upper portion of the vertical panel arm is bent outwardly at 90 degrees forming a brace ledge. A pair of brace tabs are formed in the center portion of the connecting arm and bent inwardly at 90 degrees. The brace ledge and the brace tabs are used for receiving a portion of the wood brace thereon. When the eccentric handle engages the tie-rod, the upper portion of the connecting arm compresses the wood brace against the plywood panel.

These and other objects of the present invention will become apparent to those familiar with the different types of concrete form clamp brackets and waler brackets when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENTS

Figure 1:
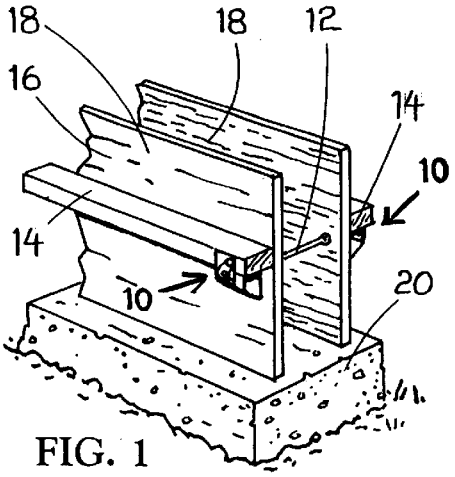
FIG. 1 is a perspective view of a pair of clamp/waler brackets attached to opposite ends of a tie-rod and engaging a pair of wood braces. The wood braces are disposed against the outside of a pair of vertical, parallel, spaced apart plywood panels. The tie rod is received through the spaced apart plywood panels. The panels are shown received on top of a concrete foundation pad.
Figure 3:
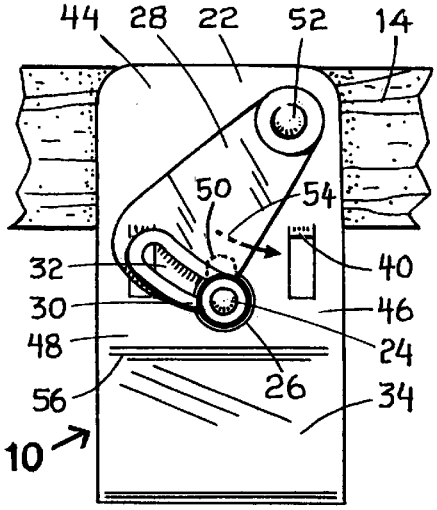
FIG. 3 is a front view of the clamp/waler bracket illustrating a vertical tie-rod connecting arm with an eccentric handle pivotly mounted on the connecting arm and in an open unlocked position.
Figure 4:
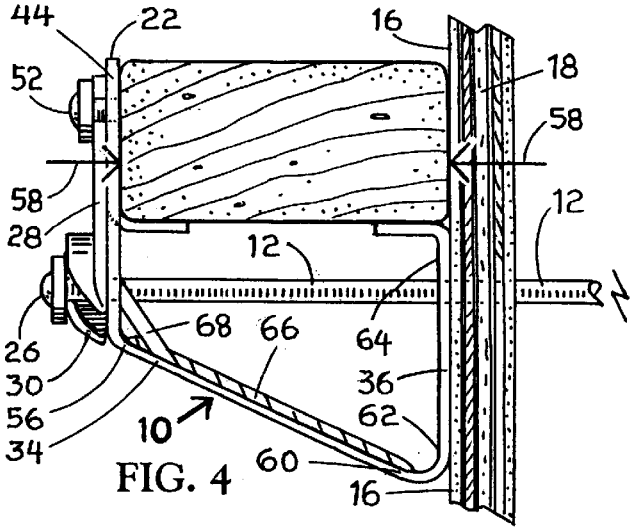
FIG. 4 is a side view of the bracket shown in FIG. 3 and illustrating the eccentric handle in a locked position engaging a portion of the tie-rod with an upper portion of the connecting arm compressing the wood brace against an outside of the plywood panel. The wood brace is shown received on top of brace ledge and brace tabs which are part of the bracket.

In FIG. 1, a perspective view of a pair of clamp/waler brackets are illustrated. The clamp/waler bracket is shown having a general reference numeral 10. The brackets 10, in this drawing, are attached to opposite ends of a tie-rod 12 and shown engaging the side of a pair 2×4 inch of wood braces 14. The wood braces 14 are disposed against an outside 16 of a pair of vertical, parallel and spaced apart 4×8 foot plywood panels 18. The opposite ends of the tie rod 12 are received through the spaced apart plywood panels 18. The panels 18 are shown received on top of a concrete foundation pad 20. While the 2×4 inch wood braces 14 and the 4×8 foot plywood panels 18 are discussed herein, it should be kept in mind that various types and sizes of braces and panels made of different types of construction material can be used equally well with the subject clamp/waler bracket 10 and without departing from the spirit and scope of the invention. The clamp/waler bracket in FIGS. 2, 3 and 4 is called an "Open Body A" bracket.

Figure 2:
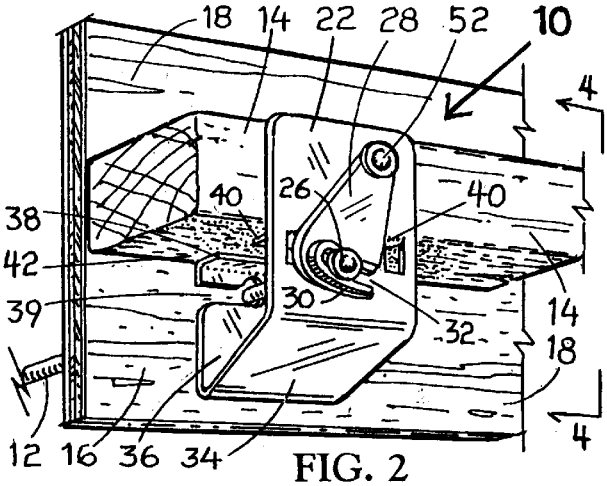
FIG. 2 is another perspective view of a clamp/waler bracket releaseably attached to a portion of the tie-rod and clamped against the side of one of the wood braces. The wood brace mounted horizontally and received against an outside of one of the plywood panels. The bracket is shown with an eccentric handle in a locked position compressing the wood brace against the plywood panel.

In FIG. 2, another perspective view of one of the clamp/waler brackets 10 is shown releaseably attached to a portion of the tie-rod 12 and clamped against the side of a wood brace 14. Broadly, the bracket 10 includes a vertical tie-rod connecting arm 22 having a hole 24 for receiving a tie-head 26 attached to an end of the tie-rod 12 and a portion of the tie-rod 12 therethrough. An eccentric handle 28 with a cam 30 and cam channel 32 is pivotly attached to the connecting arm 22. In this view, the eccentric handle 28 is shown in a locked position with the cam channel 32 received around a portion of the tie-rod 26. The hole 24, the cam 30 and cam channel 32 are shown more clearly in FIGS. 3 and 5.

An angle arm 34 is integrally formed at the bottom of the connecting arm 22. The angle arm 34 extends downwardly and at an angle in a range of 30 to 75 degrees from the vertical tie-rod connecting arm 22. An opposite end of the angle arm 34 is integrally formed at the bottom of a vertical panel arm 36.

The vertical panel arm 36 is adapted for receipt next to the outside 16 of the plywood panel 18. The vertical panel arm 36 is shown with a tie-rod notch 39 in its side for receiving a portion of the tie-rod 12 when installing the bracket 10 against the outside 16 of the plywood panel 18. The top of the vertical panel arm 36 is bent outwardly at 90 degrees forming a brace ledge 38.

A pair of brace tabs 40 are formed in the connecting arm 22 and bent inwardly at 90 degrees. The brace ledge 38 and the brace tabs 40 are used for receiving a portion of the wood brace 14 thereon. It should be noted that an open space 42 is left between the brace ledge 38 and the brace tabs 40 which allow the bracket 10 to either expand or be compressed when the width of different wood braces 14 vary and are received on top of the brace ledge 38 and the brace tabs 40. This important feature allows the bracket 10 to be tightened against the sides of the wood brace 14 without bending the bracket 10. Also, the prior art "Jahn" bracket or the "A" bracket included a wood brace member extending completely across the width of the bracket of receiving the wood brace 14 thereon. This prior wood brace member has been eliminated, thereby reducing material cost by using the brace ledge 38 and the brace tabs 40. When the eccentric handle 28 engages the tie-rod 12 in a locked position as shown in FIG. 2, the connecting arm 22 compresses the wood brace 14 against the plywood panel 18.

In FIG. 3, a front view of the clamp/waler bracket 10 is shown with the vertical tie-rod connecting arm 22 having an upper portion 44, a center portion 46 and a lower portion 48. The center portion 46 of the connecting arm 22 includes the hole 24 with a hole notch 50. The hole notch 50 is used to receive a portion of the tie-rod 12 as it moves upwardly when tightened using the cam 30 of the eccentric handle 28 as shown in FIG. 2.

Figure 5:
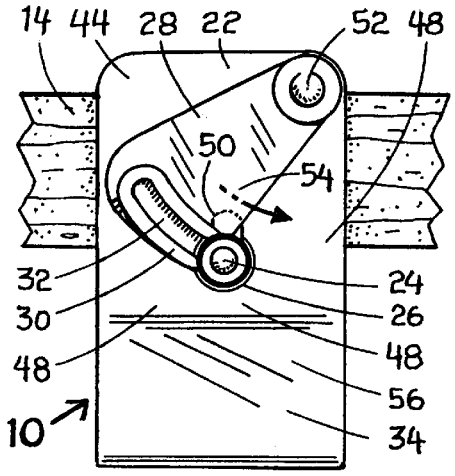
FIG. 5 is a front view of another embodiment of the clamp/waler bracket and similar to the bracket shown in FIG. 3. but without brace ledge and brace tabs used for receiving the wood brace thereon. The eccentric handle is shown in an unlocked position.

The eccentric handle 28 is pivotly attached using a pivot pin 52 to the upper portion 44 of the connecting arm 22. The movement of the eccentric handle 28 from an unlocked position as shown in FIGS. 3 and 5 to a locked position is indicated by arrow 54.

A first end 56 of the angle arm 34 is integrally formed in the lower portion 48 of the connecting arm 22. The angle arm 34 extends downwardly and at an angle in a range of 30 to 60 degrees from the vertical tie-rod connecting arm 22.

In FIG. 4, a side view of the bracket 10 shown in FIG. 3 is illustrated with the eccentric handle 28 in a locked position engaging a portion of the tie-rod 12. In this drawing, the upper portion 44 of the connecting arm 22 is shown compressing the wood brace 14 against the outside 16 of the plywood panel 18 as indicated by arrows 58. The wood brace 14 is shown resting on top of brace ledge 38 and brace tabs 40.

A second end 60 of the angle arm 34 is shown integrally formed in a lower portion 62 of the vertical panel arm 36. The brace ledge 38 is integrally formed in an upper portion 64 of the panel arm 36. The vertical panel arm 36, as mentioned above, is adapted for receipt next to the outside 16 of the plywood panel 18. The angle arm 34 is shown with a reinforcing rib 66 and a pair of gussets 68 which add strength to the angle arm 34. This added strength to the angle arm 34 helps hold the connecting arm 22 and the panel arm 36 in an upright vertical position when the clamp/waler bracket 10 is in use and under compression. Only one of the gussets 68 is shown in the drawings. Also gussets 68 can be used between the angle arm 34 and vertical panel arm 36 for adding strength in this area of the bracket 10.

Figure 6:
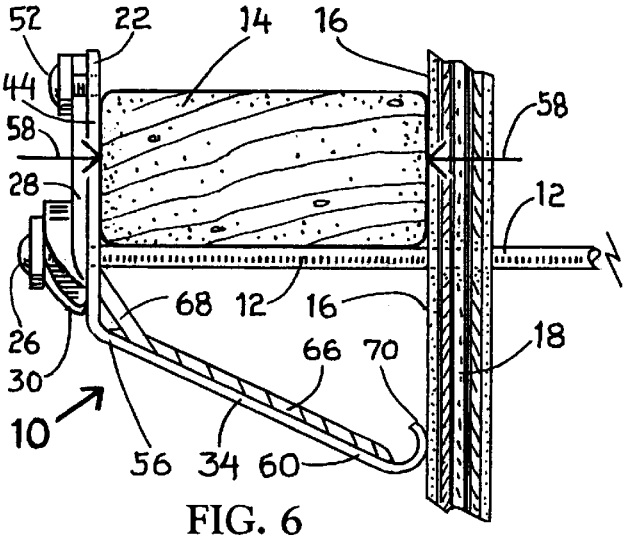
FIG. 6 is a side view of the bracket shown in FIG. 5 and with the eccentric handle in a locked position. The wood brace is shown resting on top of the tie-rod.

In FIG. 5, a front view of another embodiment of the clamp/waler bracket 10 is shown which is similar to the bracket shown in FIG. 3. The bracket 10 shown in FIGS. 5 and 6 is called the "J" bracket. The connecting arm 22 is the same as the connecting arm 22 shown in FIG. 3, but the center portion 46 does not include the brace tabs 40 formed therein.

In FIG. 6, a side view of the bracket 10 in FIG. 5 is shown with the eccentric handle 28 in a locked position. The angle arm 34 is similar to the angle arm 34 shown in FIG. 4, but the second end of the angle arm 34 is bent upwardly forming a panel flange 70. The panel flange 70 eliminates the use of the vertical panel arm 36 and the brace ledge 38 shown in FIGS. 2 and 4. In this example, the bracket 10 uses the tie-rod 12 for resting the bottom of the wood brace 14 thereon. The upper portion 44 of the connecting arm 22 is used to compress the wood brace 14 against the plywood panel 18, as indicated by arrows 58, when the eccentric handle 28 is in a locked position on the tie-rod 12. While the panel flange 70 is shown, the end of the angle arm 34 might also be used to engage the side of the panel 18 rather than use the flange 70.

Obviously, the second embodiment or the "J" bracket as shown in FIGS. 5 and 6 further reduces material cost of the clamp/waler bracket 10 by not using the vertical panel member 36 and brace ledge 38. Also, this design leaves an open space between the vertical tie-rod connecting member 22 and the outside 16 of the plywood panel 18 so that various sizes of the wood brace 14 can be received on the tie-rod 12 without bending the clamp/waler bracket 10 when the brace 14 is compressed thereon.

While the invention has been shown, described and illustrated in detail with reference to the preferred embodiments and modifications thereof, it should be understood by those skilled in the art that equivalent changes in form and detail may be made therein without departing from the true spirit and scope of the invention as claimed, except as precluded by the prior art.

The embodiments of the invention for which an exclusive privilege and property right is claimed are defined as follows:

1. A clamp/waler bracket used in concrete form construction, the clamp/waler bracket is used to releasably engage a tie-rod extending outwardly from an outside of a plywood panel, the bracket used to compress a wood brace against the side of the plywood panel, the bracket comprising:

a tie-rod connecting arm having an upper portion, a lower portion and a center portion, the center portion having a hole therein adapted for receiving a portion of the tie-rod therethrough;

a handle attached to said connecting arm and adapted for engaging a portion of the tie-rod;

an angle arm having a first end attached to a lower end of said connecting arm, said angle arm extending downwardly and at an angle from said connecting arm;

a pair of gussets, opposite ends of said gussets attached to said angle arm and said connecting arm for adding strength to said angle arm;

a vertical panel arm having a lower end attached to a second end of said angle arm, said vertical panel arm adapted for receipt next to the outside of the plywood panel, an upper portion of said vertical panel arm bent outwardly at 90 degrees forming a brace ledge; and a brace tab formed in the center portion of said connecting arm and bent inwardly at 90 degrees from said connection arm, said brace ledge and said brace tab adapted for receiving a portion of the wood brace thereon.

2. The bracket as described in claim 1 wherein the lower end of said connecting arm is integrally formed in the first end of said angle arm.

3. The bracket as described in claim 1 wherein the lower end of said vertical panel arm is integrally formed in the second end of said angle arm.

4. The bracket as described in claim 1 wherein said handle is an eccentric handle pivotly attached to said connecting arm.

5. The bracket as described in claim 1 wherein said angle arm is disposed at an angle in a range of 30 to 75 degrees from the vertical.

6. The bracket as described in claim 1 wherein said vertical panel arm includes a tie-rod notch therein, said tie-rod notch adapted for receiving a portion of the tie-rod therein.

7. The bracket as described in claim 1 wherein said angle arm includes a reinforcing rib formed therein and along a length of said angle arm for adding strength to said angle arm.

8. The bracket as described in claim 1 further including a pair of brace tabs formed in the center portion of said connecting arm and bent inwardly at 90 degrees from said connection arm, said brace ledge and said brace tabs adapted for receiving a portion of the wood brace thereon.

9. A clamp/waler bracket used in concrete form construction, the clamp/waler bracket is used to releasably engage a tie-rod extending outwardly from an outside of a plywood panel, the bracket used to compress a wood brace against the side of the plywood panel, the bracket comprising:

a tie-rod connecting arm having an upper portion, a lower portion and a center portion, the center portion having a hole therein adapted for receiving a portion of the tie-rod therethrough;

a eccentric handle pivotly attached to the upper portion of said connecting arm and adapted for engaging a portion of the tie-rod;

an angle arm having a first end attached to a lower end of said connecting arm, said angle arm extending downwardly and at an angle from said connecting arm;

a vertical panel arm having a lower end attached to a second end of said angle arm, said vertical panel arm adapted for receipt next to the outside of the plywood panel, an upper portion of said vertical panel arm bent outwardly at 90 degrees forming a brace ledge; and a pair of brace tabs formed in the center portion of said connecting arm and bent inwardly at 90 degrees from said connection arm, said brace ledge and said brace tabs adapted for receiving a portion of the wood brace thereon.

10. The bracket as described in claim 9 wherein said angle arm is disposed at an angle in a range of 30 to 75 degrees from the vertical.

11. The bracket as described in claim 9 wherein said vertical panel arm includes a tie-rod notch therein, said tie-rod notch adapted for receiving a portion of the tie-rod therein.

12. The bracket as described in claim 9 wherein said angle arm includes a reinforcing rib formed therein and along a length of said angle arm for adding strength to said angle arm.

13. The bracket as described in claim 9 further including a pair of gussets, opposite ends of said gussets attached to said angle arm and to the lower portion of said connecting arm for adding strength to said angle arm.

14. A clamp/waler bracket used in concrete form construction, the clamp/waler bracket is used to releasably engage a tie-rod extending outwardly from an outside of a plywood panel, the bracket used to compress a wood brace against the side of the plywood panels, the bracket comprising:

a tie-rod connecting arm having an upper portion, a lower portion and a center portion, the center portion having a hole therein adapted for receiving a portion of the tie-rod therethrough;

a handle attached to said connecting arm and adapted for engaging a portion of the tie-rod;

an angle arm having a first end attached to a lower end of said connecting arm, said angle arm extending downwardly and at an angle from said connecting arm, said angle arm having a reinforcing rib formed therein and along a length of said angle arm for adding strength to said angle arm; and a panel flange formed in a second end of said angle arm, said panel flange adapted for receipt against the outside of the panel.

15. The bracket as described in claim 14 wherein said handle is an eccentric handle pivotly attached to the upper portion of said connecting arm.

16. The bracket as described in claim 14 wherein said angle arm is disposed at an angle in a range of 30 to 75 degrees from the vertical.

17. The bracket as described in claim 14 further including a pair of gussets, opposite ends of said gussets attached to said angle arm and to the lower portion of said connecting arm for adding strength to said angle arm.

* * * * *